US011130222B2

(12) United States Patent
Eisenhauer, III et al.

(10) Patent No.: US 11,130,222 B2
(45) Date of Patent: Sep. 28, 2021

(54) SPARE STAPLE STORAGE DEVICE

(71) Applicant: Robert B. Eisenhauer, III, Melbourne, FL (US)

(72) Inventors: Robert B. Eisenhauer, III, Melbourne, FL (US); Ricardo Romeu, Melbourne, FL (US)

( * ) Notice: Subject to any disclaimer, the term of this patent is extended or adjusted under 35 U.S.C. 154(b) by 37 days.

(21) Appl. No.: 16/726,400

(22) Filed: Dec. 24, 2019

(65) Prior Publication Data

US 2020/0331134 A1 Oct. 22, 2020

Related U.S. Application Data

(63) Continuation-in-part of application No. 16/388,134, filed on Apr. 18, 2019.

(51) Int. Cl.
*B25C 5/16* (2006.01)

(52) U.S. Cl.
CPC ..... *B25C 5/1679* (2013.01)

(58) Field of Classification Search
None
See application file for complete search history.

(56) References Cited

U.S. PATENT DOCUMENTS 3,266,696 A * 8/1966 Tyszkiewicz ..... B25C 5/1679 227/120
3,640,443 A * 2/1972 Itagaki ..... B25C 5/025 227/120
4,717,062 A * 1/1988 Ebihara ..... B25C 5/025 227/120
5,501,387 A * 3/1996 Yoshie ..... B25C 5/1686 206/340
5,560,529 A * 10/1996 Udagawa ..... B25C 5/1686 227/120
7,299,921 B2 * 11/2007 Yoshie ..... B25C 5/1686 206/340

OTHER PUBLICATIONS

U.S. Appl. No. 16/388,134, filed Apr. 18, 2019.

* cited by examiner

*Primary Examiner* — Hemant Desai
*Assistant Examiner* — Tanzim Imam
(74) *Attorney, Agent, or Firm* — Kelly G. Swartz; Widerman Malek, PL

(57) ABSTRACT

A spare staple storage device including a housing, a retaining mechanism, an end cap, a first magnet, and a second magnet. The housing having a first end, an opposing second end, and being adapted to secure to a stapler. The retaining mechanism carried by the housing and having a first end, adapted to selectively occlude a first opening at the first end of the housing, and an opposing second end. The end cap secured to the second end of the housing. The first magnet secured to the retaining mechanism at the second end of the retaining mechanism. The second magnet carried by the end cap and positioned to attract the first magnet and retain the retaining mechanism is in a closed configuration.

18 Claims, 14 Drawing Sheets

SPARE STAPLE STORAGE DEVICE

RELATED APPLICATIONS

This application is a continuation-in-part application of and claims priority under 35 U.S.C. § 120 to U.S. patent application Ser. No. 16/388,134 filed on Apr. 18, 2019 and titled SPARE STAPLE STORAGE DEVICE. The content of this application is incorporated herein by reference.

FIELD OF THE INVENTION

The present invention relates to systems for containing spare staple strips. More specifically, the present invention relates to a spare staple storage device, which may be secured to or integrated with a stapler and adapted to contain one or more spare staple strips.

BACKGROUND OF THE INVENTION

Staplers for stapling together papers or securing sheets to objects are in common use. These devices used in office environments generally include a base portion with an anvil surface, a manually operable pusher arm, and a magazine in the pusher arm that holds a strip of staples and that feeds them against the anvil in a stapling process. In some embodiments of staplers, commonly referred to as staple guns, used to secure paper or other sheets of material to solid object, there is often no base portion and the pusher arm is replaced with a trigger, which is activated by an operator tightening his or her grip on the trigger to advance a staple from the staple strip out of the magazine and into the object against which the mouth of the stapler is positioned. Each time the strip of staples loaded into the stapler is exhausted, it is necessary for the operator to stop the job and obtain a new strip of staples from the supply area for reloading the stapler magazine. Oftentimes the operator does not wish to interrupt the job for any length of time to locate the staple supply are and obtain a new strip for reloading. Sometimes the refill staple strips are stored in a location removed from the location at which the operator is using the stapler. Also, oftentimes the staple supply is entirely exhausted whereby the job must be stopped altogether. Therefore, there exists a need for a device that secures to or is integrated with the stapler and holds spare staple strips, while allowing the stapler to operate conventionally.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a spare staple storage device including a housing, a retaining mechanism, an end cap, a first magnet, and a second magnet.

The housing may have a first end and an opposing second end and may be adapted to secure to a stapler. The housing may include a channel configured to capture an elongate portion of the retaining mechanism and allow rotational movement of the retaining mechanism about an axis extending along a length of the channel. The housing may include an interior wall dividing an interior portion of the housing into a first chamber adapted to carry a plurality of staples and a second chamber adapted to carry an elongate portion of the retaining mechanism. The housing may include a housing cover positioned along the length of the elongate portion of the retaining mechanism.

A first centerline may extend vertically from a top surface to a bottom surface of the housing, perpendicular to the length of the housing. A second centerline may extend vertically from a top surface to a bottom surface of the housing, along a length of the housing. The housing may be symmetrical about the first and/or second centerline.

The retaining mechanism may be carried by the housing and have a first end, adapted to selectively occlude a first opening at the first end of the housing, and an opposing second end. The retaining mechanism may include an elongate portion, a protuberance, and a magnet retainer. The elongate portion may have a first and an opposing, second end. The protuberance may be secured to the first end of the retaining mechanism and extending beyond an outer perimeter of the elongate portion, perpendicular to a length of the elongate portion, to occlude the first opening when in the closed configuration. The magnet retainer may be positioned below an elongate portion of the retaining mechanism. The magnet retainer may carry the first magnet. The magnet retainer may include a hollow tube.

The end cap may be secured to the second end of the housing.

The first magnet may be secured to the retaining mechanism at the second end of the retaining mechanism.

The second magnet may be carried by the end cap and positioned to attract the first magnet and retain the retaining mechanism is in a closed configuration.

The spare staple storage device may further include a third magnet carried by the end cap and positioned to attract the first magnet and retain the retaining mechanism is in a first open configuration. The spare staple storage device may further include a fourth magnet carried by the end cap and positioned to attract the first magnet and retain the retaining mechanism is in a second open configuration.

The end cap may include a first end cap magnet retainer positioned to align the second magnet with the first magnet to retain the retaining mechanism in the closed configuration. The end cap may include a second end cap magnet retainer positioned to align the third magnet with the first magnet to retain the retaining mechanism in the first open configuration. The end cap may include a third end cap magnet retainer positioned to align the fourth magnet with the first magnet to retain the retaining mechanism in the second open configuration.

The end cap may include an aperture providing a pathway between the first chamber and a volume external to the spare staple storage device.

The first end cap magnet retainer may include a first hollow tube. The second end cap magnet retainer may include a second hollow tube. The third end cap magnet retainer may include a third hollow tube.

The first magnet retainer may have a vertical centerline extending vertically from a top surface of the first magnet retainer to a bottom surface of the first magnet retainer. The second end cap magnet retainer may be located on a first side of the vertical centerline. The third end cap magnet retainer may be located on a second side of the vertical centerline.

The first magnet retainer may have a horizontal centerline extending horizontally from a left side surface of the first magnet retainer to a right side surface of the first magnet retainer. The second end cap magnet retainer may be located on a first side of the horizontal centerline. The third end cap magnet retainer may be located on the first side of the horizontal centerline.

The second end cap magnet retainer and third end cap magnet retainer may be equidistant from the vertical centerline. The second end cap magnet retainer and third end cap magnet retainer may be equidistant from the horizontal centerline.

DETAILED DESCRIPTION OF THE INVENTION

Figure 1:
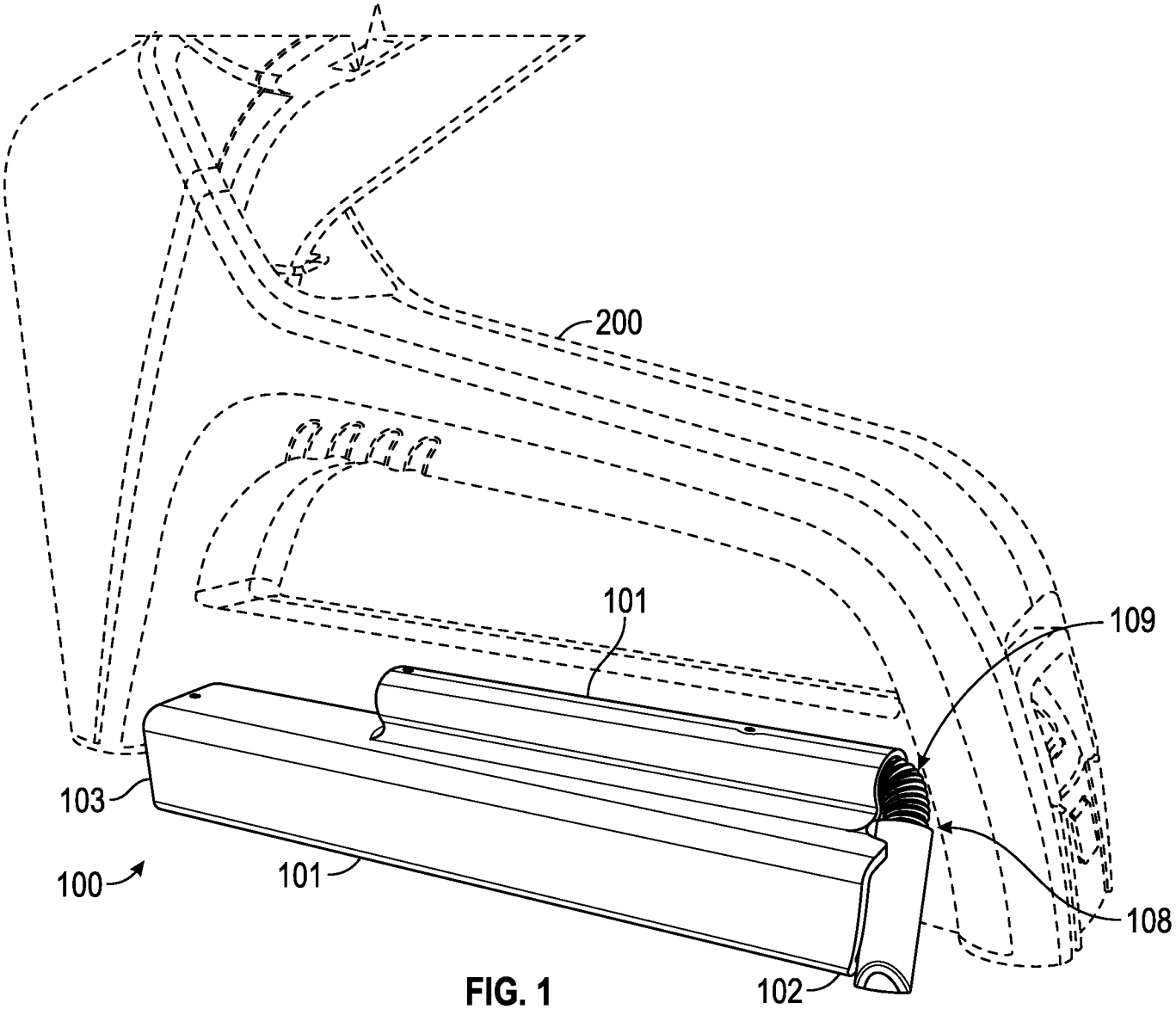
FIG. 1 is an environmental view of a spare staple storage device according to an embodiment of the present invention.
Figure 2:
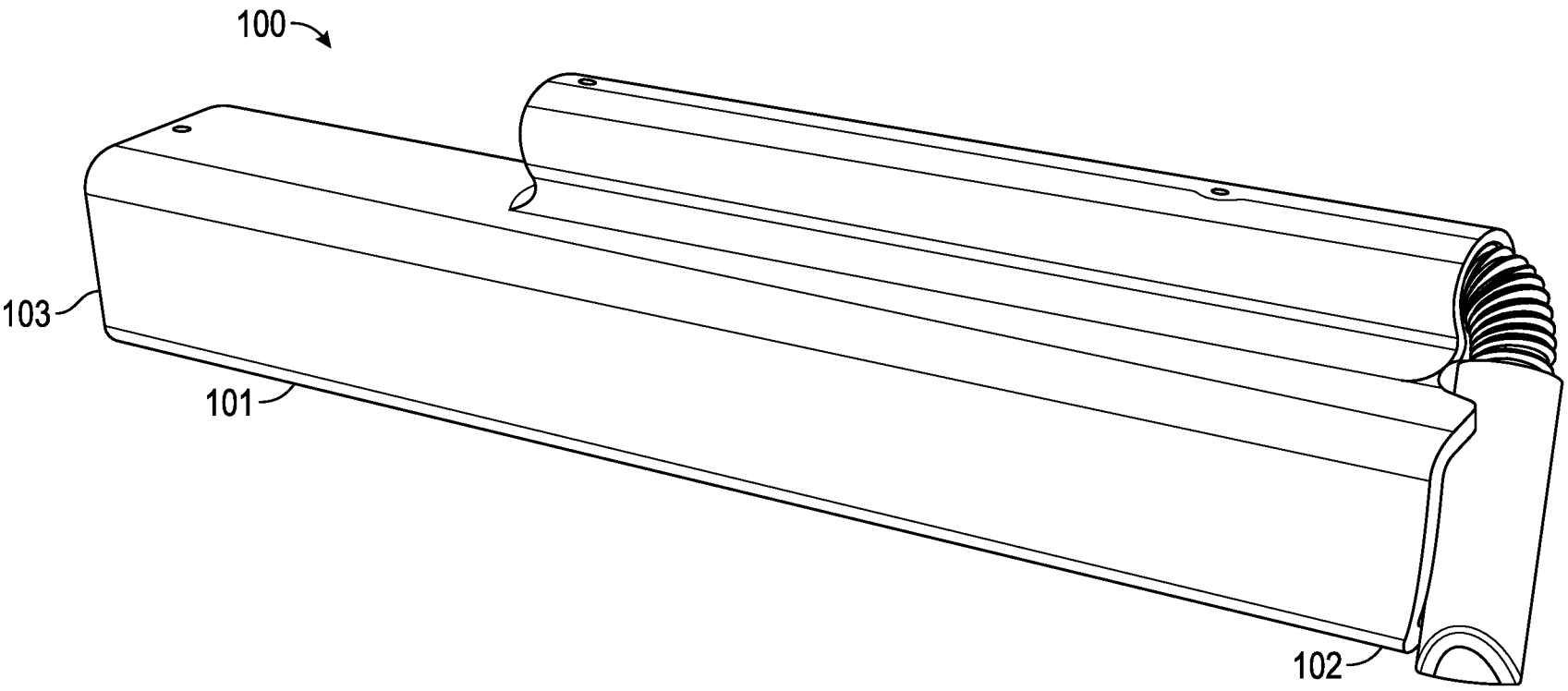
FIG. 2 is a perspective view of the spare staple storage device of FIG. 1.
Figure 3:
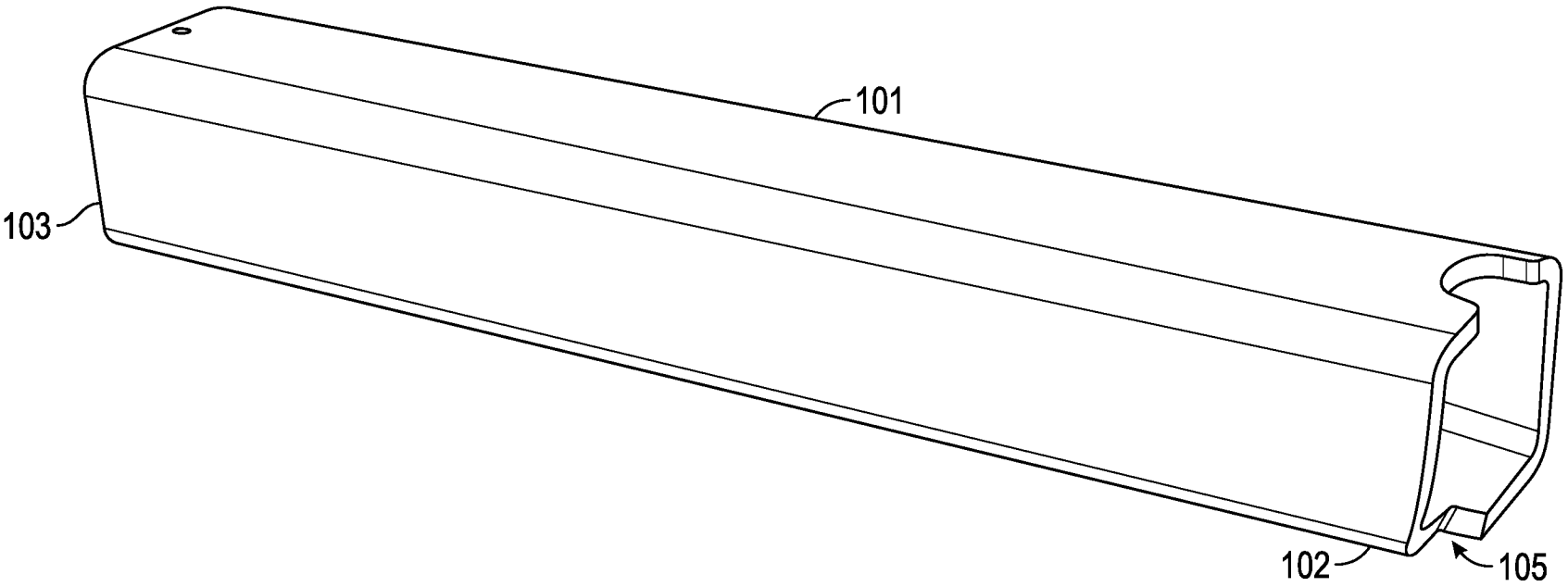
FIG. 3 is perspective view of the housing of the spare staple storage device of FIG. 1.
Figure 4:
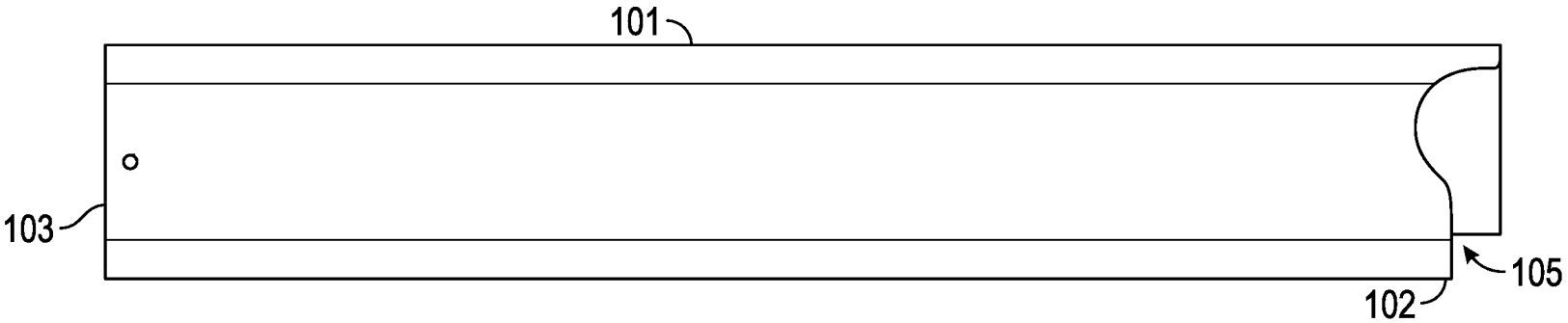
FIG. 4 is a top plan view of the housing of the spare staple storage device of FIG. 3.
Figure 5:
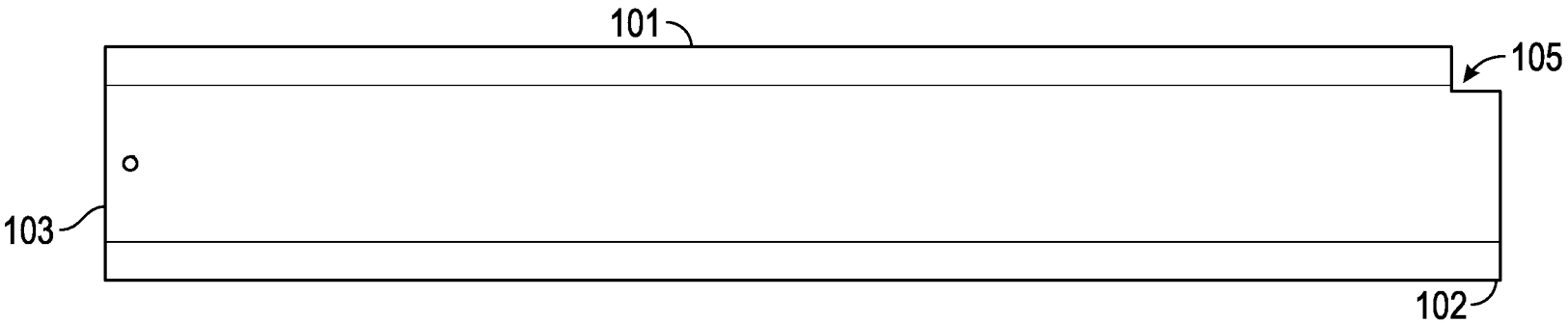
FIG. 5 is a bottom plan view of the housing of the spare staple storage device of FIG. 3.
Figure 6:
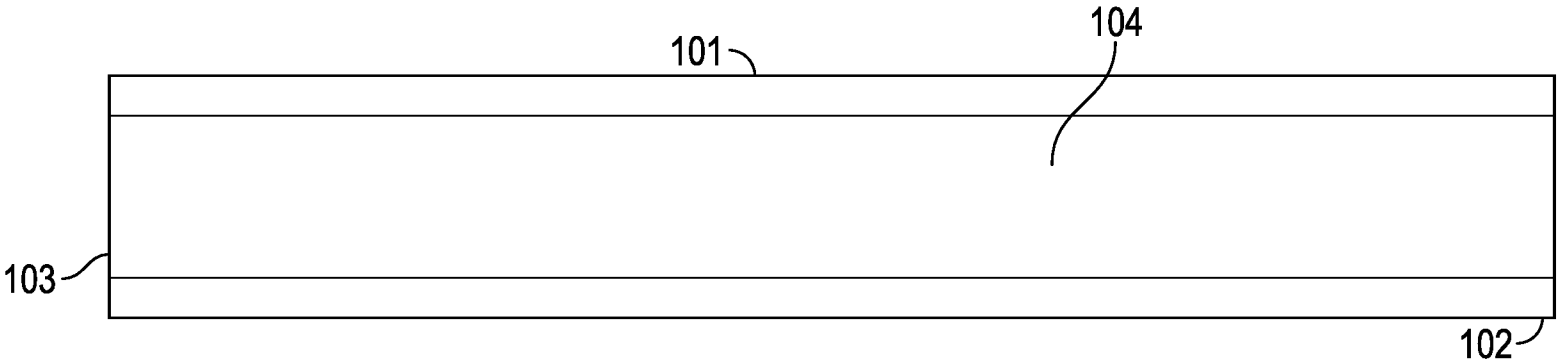
FIG. 6 is a first side elevation view of the housing of the spare staple storage device of FIG. 3.
Figure 7:
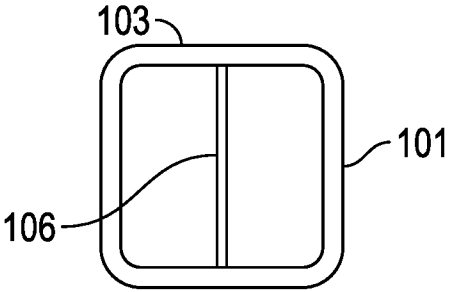
FIG. 7 is a rear elevation view of the housing of the spare staple storage device of FIG. 3.
Figure 8:
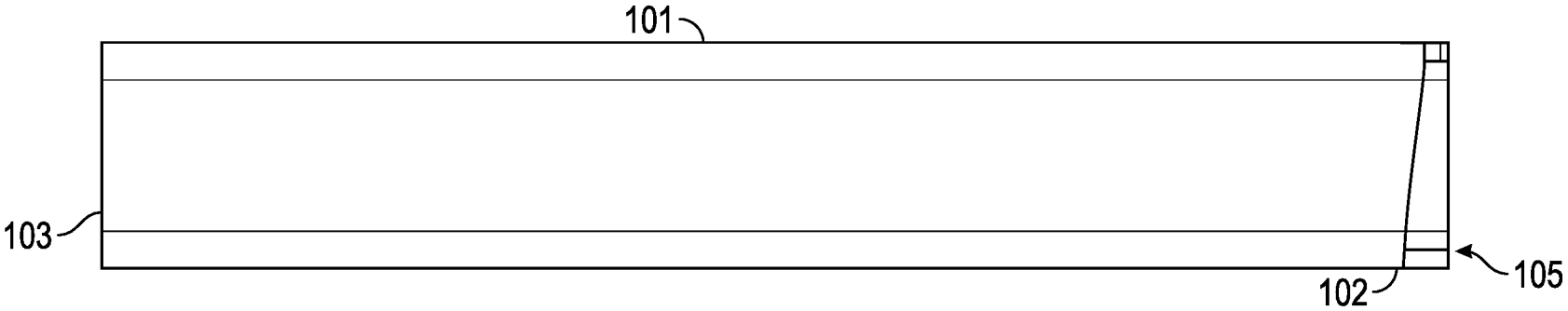
FIG. 8 is a second side elevation view of the housing of the spare staple storage device of FIG. 3.
Figure 9:
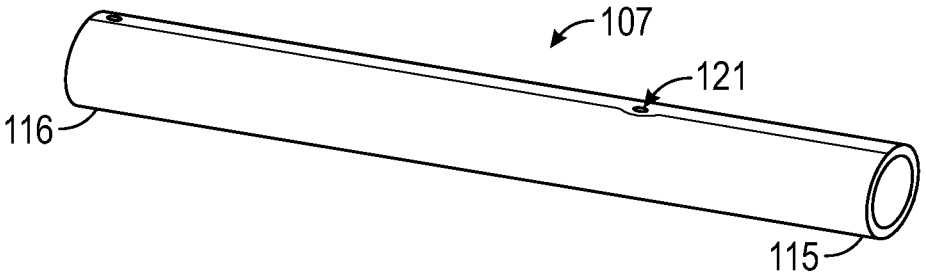
FIG. 9 is a perspective view of the retaining mechanism carrier of the spare staple storage device of FIG. 1.
Figure 10:
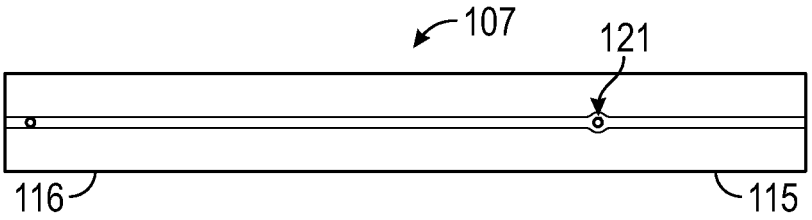
FIG. 10 is a top plan view of the retaining mechanism carrier of FIG. 9.
Figure 11:
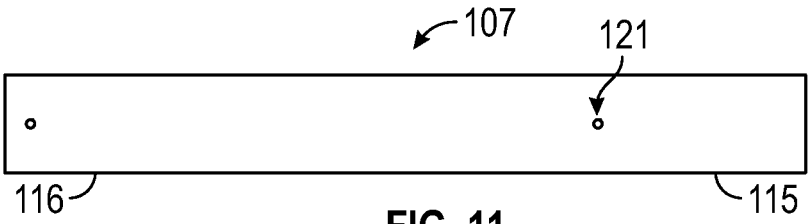
FIG. 11 is a bottom plan view of the retaining mechanism carrier of FIG. 9.
Figure 12:
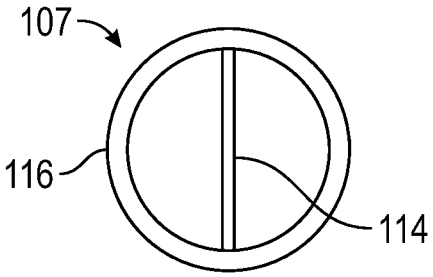
FIG. 12 is a rear elevation view of the retaining mechanism carrier of FIG. 9.
Figure 13:
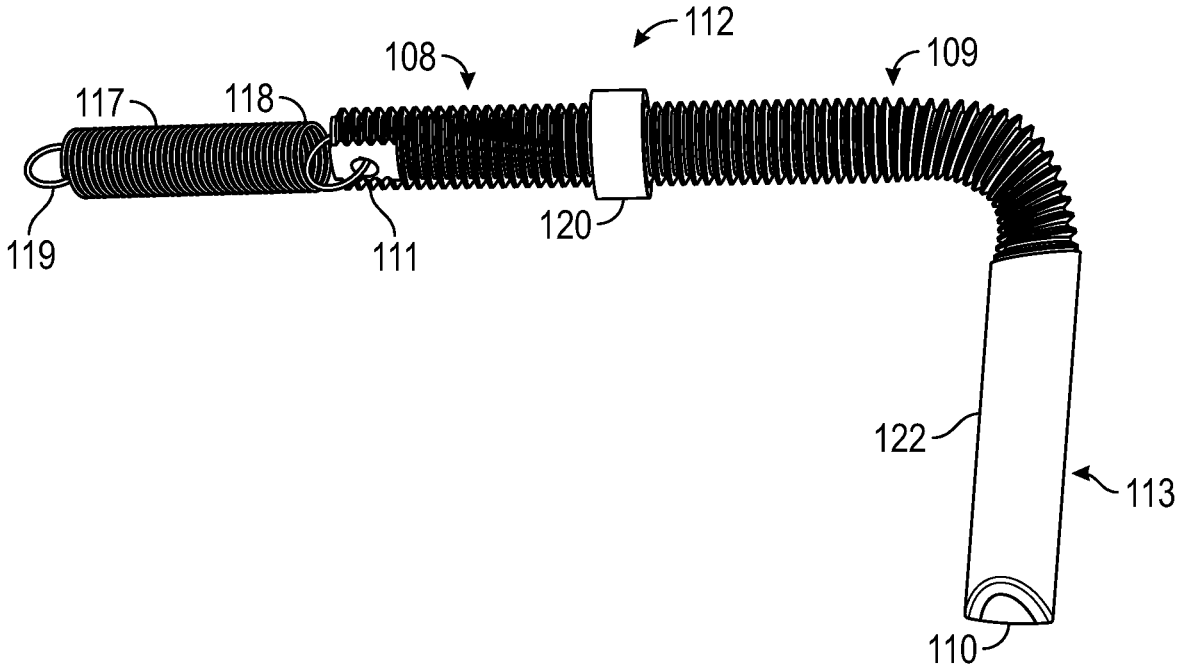
FIG. 13 is a perspective view of the retaining mechanism of the spare staple storage device of FIG. 1.
Figure 14:
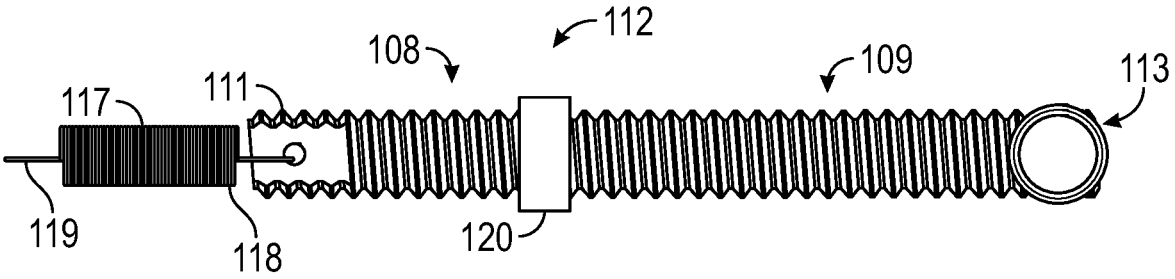
FIG. 14 is a bottom plan view of the retaining mechanism of FIG. 12.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a spare staple storage device 100. The spare staple storage device 100 may be affixed to a stapler 200 as an after-market accessory or may be integrated into the stapler body. The spare staple storage device 100 may be adapted to carry one or more strips of staples within a housing 101. The spare staple storage device 100 may be especially beneficial for use with staple guns or other staplers, which may be used in locations in which staple stick refills may not be readily available. One or more staple sticks may be placed into the housing 101 of the spare staple storage device 100. The stapler 200 may then be operated as normal. When the operator runs out of staples, the stapler may be conveniently refilled using a spare staple stick carried within the housing 101.

The spare staple storage device 100 may have a housing 101, a retaining mechanism carrier 107, and a retaining mechanism 108. One or more spare staple strips may be carried by the housing 101. The retaining mechanism carrier 107 may be affixed to the housing 101 and carry the retaining mechanism 108, which may be adapted to selectively occlude a first opening of the housing.

The housing 101 may have an interior void sized to carry one or more strips of staples compatible with the stapler to which the spare staple storage device 100 is secured. Inner walls of the housing 101 may define the void within the housing. The void of the housing 101 may have a length slightly greater than a length of a staple strip. The inner void of the housing 101 may have a width slightly greater than a width of a staple strip. The inner void of the housing 101 may have a height greater than a height of a staple strip. In one embodiment, the inner void of the housing 101 may be sized to carry a plurality of staple strips. The housing 101 may be an elongate, hollow member having a first end 102 and an opposing second end 103. The first end 102, the second end 103, or both, may be open. The housing may include a hollow tube. In embodiments in which the housing is a hollow tube, the tube may have a round, rectangular, or square cross-section.

Staple strips may be placed into or removed from the housing 101 through a first opening in the first end 102 of the housing 101. This first opening may be selectively occluded by the retaining mechanism 108, which may be positionable to prevent or allow the one or more staple strips from passing through the first opening. The retaining mechanism 108 may be held in a closed positioned by a detent 105 located in the first end 102 of the housing 101. The retaining mechanism 108 may be moved to an open position by pulling the retaining mechanism 108 away from the housing 101 to remove interference with the detent 105 and rotating the retaining mechanism 108 to a position that does not obstruct the first opening in the first end 102 of the housing.

The detent 105 may be formed in the first end 102 of the housing 101 and adapted to maintain the retaining mechanism 108 in a closed position with an interference fit. The detent 105 may be defined by the profile of the first end 102 of the housing 101. The detent 105 may include a first concave arc on a first side of the upper edge of the first end 102 of the housing 101. The curvature of the first concave arc may mirror the curvature of the portion of the retaining mechanism 108 to be received by the first concave arc when the spare staple storage device 100 is in a closed configuration. The detent 105 may include a second concave arc on a second side of the lower edge of the first end 102 of the housing 101. The curvature of the second concave arc may mirror the curvature of the portion of the retaining mechanism 108 to be received by the second concave arc when the spare staple storage device 100 is in a closed configuration. When positioned in the detent 105, the retaining mechanism 108 may extend from the top to the bottom of the first end 102 of the housing 101 and from a first side to a second side of the first end 102 of the housing 101. The second side of the first end 102 of the housing 101 may be recessed compared to the first side of the first end 102 of the housing 101. Such a recess may make it easier to rotate the retaining mechanism 108 from a closed position to an open position. The second concave arc may be recessed compared to the first concave arc for the same reason.

An elongate occluding member 106 may be positioned across the second end 103 of the housing 101 to occlude a second opening located in the second end 103. There may be a first aperture located on the top of the housing 101 near the second end 103 and a second aperture located on the bottom of the housing 101 opposite the first aperture. In one embodiment, there may be a first aperture located on a first side of the housing 101 near the second end 103 and a second aperture located on a second, opposing side of the housing 101 opposite the first aperture. The elongate occluding member 106 may be carried by and secured within both the first aperture and the second apertures. The elongate occluding member 106 may be secured to the housing 101 with adhesive or welds.

An exterior side of the housing 101 may have a flat surface 104 extending the entirety of the length of the housing 101 between the first end 102 and the second end 103. The flat surface 104 may have a width and length smaller than or equal to a surface on the stapler 200, to which the spare staple storage device 100 may be secured with adhesive, welds, fasteners, or the like. The spare staple storage device 100 may be permanently or removably secured to the stapler at the flat surface 104 and corresponding surface of the stapler 200. In one embodiment, the spare staple storage device 100 may be integrally formed with the stapler 200 and not secured thereto along a flat surface. In such an embodiment, the housing 101 may be integrated into the structure of the stapler 200.

The retaining mechanism carrier 107 may be an elongate, hollow tube adapted to carry at least a portion of the retaining mechanism 108. The retaining mechanism carrier 107 may have an open first end 115 and an opposing, open second end 116. The retaining mechanism carrier 107 may include a first aperture on a top surface and a second aperture located on an opposing bottom surface, aligned with the first aperture and between the first end 115 and second end 116. In one embodiment, the first aperture may be on a side surface and the second aperture may be on an opposing side surface, aligned with the first aperture and between the first end 115 and second end 116. An elongate fastening member 114 may be carried by and extend between the first and second apertures of the retaining mechanism carrier 107. The elongate fastening member 114 may be secured within the apertures by adhesive or welds. The elongate fastening member 114 may occlude the second end of the retaining mechanism carrier 116 and provide structure to which the elongate retaining member 109 may be secured.

The retaining mechanism carrier 107 may have at least one staking dimple 121 formed in a sidewall. The staking dimple 121 may be adapted to contact a nut 120 carried by the elongate retaining member 109 carried within the retaining mechanism carrier 107 and prevent the second end 111 of the elongate retaining member 109 from exiting the retaining mechanism carrier 107. The staking dimple 121 may be positioned on a wall of the retaining mechanism carrier 107 between the nut 120 and the first end 115 of the retaining mechanism carrier 107.

The retaining mechanism 108 may include an elongate retaining member 109 having a first end 110 and an opposing second end 111. The elongate retaining member 109 may be carried partially within and partially outside of the retaining mechanism carrier 107. There may be a first elongate portion 112 of the elongate retaining member 109, which may include the second end 111 of the first elongate portion 112 and may be carried substantially inside of the retaining mechanism carrier 107. There may also be a second elongate portion 113 of the elongate retaining member 109, which may include the first end 110 of the first elongate portion 112 and may not enter the retaining mechanism carrier 107. The first elongate portion 112 and the second elongate portion 113 may be components of a monolithic structure. There may be a ninety-degree bend between the first elongate portion 112 and the second elongate portion 113. Both the first elongate portion 112 and the second elongate portion 113 may be different areas on a single threaded rod forming the elongate retaining member 109.

The elongate retaining member 109 may be a rod, tube, or the like. The elongate retaining member 109 may include a threaded rod, tube, or the like. The second end 111 of the elongate retaining member 109 may have an aperture located therein. The aperture of the elongate retaining member 109 may be adapted to receive a spring 117 coil and secure the spring 117 thereto. The second end 111 of the elongate retaining member 109 may include a protuberance formed in the elongate structure. The protuberance may be formed by removing an upper and lower curved portion of the elongate structure. The outer curved surface may be removed to form the protuberance, which may have a flat lower and opposing flat upper surface extending at the second end 111 of the elongate retaining member 109. The aperture of the elongate retaining member 109 may be formed through an entirety of this protuberance.

The retaining mechanism may include a tube 122 carried by the second elongate portion 113. The tube 122 may cover a portion of the second elongate portion 113, which may include the first end 110 of the elongate retaining member 109. The tube 122 may include an outer surface which is comfortable to be gripped by a user and may contact the detent 105 formed in the first end 102 of the housing 101. The tube 122 may have a closed end located proximate the first end 110 of the elongate retaining member 109. The tube 122 may have an open end distal the closed end of the tube 122. The tube 22 may have an inner diameter slightly greater than or equal to the outer diameter of the elongate retaining member 109. The tube 122 may be secured to the elongate retaining member 109 with adhesive or welds. The elongate retaining member 109 with or without a tube 122 may be received by the detent 105 when the spare staple storage device 100 is in a closed configuration.

In embodiments in which the elongate retaining member 109 includes a threaded rod, tube, or the like, a nut 120 may be carried by the threads of the elongate retaining member 109. The nut 120 may have threads cooperatively configured to mate with the threads of the elongate retaining member 109. The nut 120 may be positionable along a length of the first elongate portion 112 of the elongate retaining member 110. The nut 120 may be positioned on the elongate retaining member 110 between the staking dimple 121 located on the retaining mechanism carrier 107 and the second end 111 of the elongate retaining member 109. The nut 120 may be sized to contact the staking dimple 121 when the first end 110 of the elongate retaining member 109 is pulled in a direction away from the retaining mechanism carrier 107, drawing the nut 120 toward the staking dimple 121. The nut 120 may contact the staking dimple 121 as the elongate retaining member 109 is pulled by the first end 110, thereby preventing the elongate retaining member 109 from being pulled out of the retaining mechanism carrier 107 and also preventing a spring 117 securing the retaining mechanism carrier 107 to the elongate retaining member 109 from hyperextending or deforming.

The retaining mechanism 108 may also include a spring 117. A first end 118 of the spring 117 may be secured to a second end 111 of the elongate retaining member 111. More specifically, a coil on the first end 118 of the spring 117 may encircle an aperture on the second end 111 of the elongate retaining member 109. A second end 119 of the spring 117 may be secured to the retaining mechanism carrier 107. More specifically, a coil on the second end 119 of the spring may encircle the elongate fastening member 114.

Figure 15:
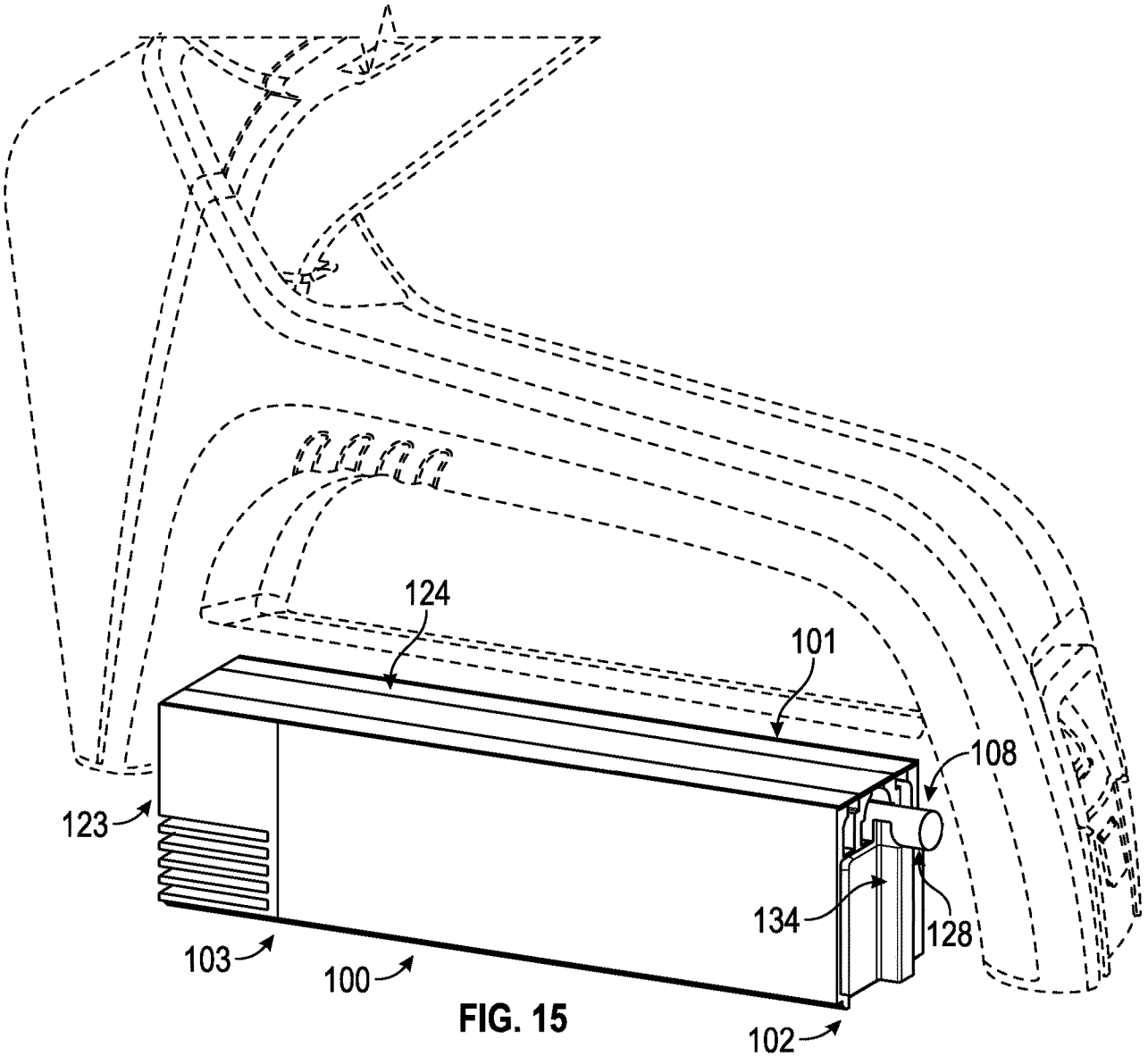
FIG. 15 is an environmental view of a spare staple storage device according to an embodiment of the present invention.
Figure 16:
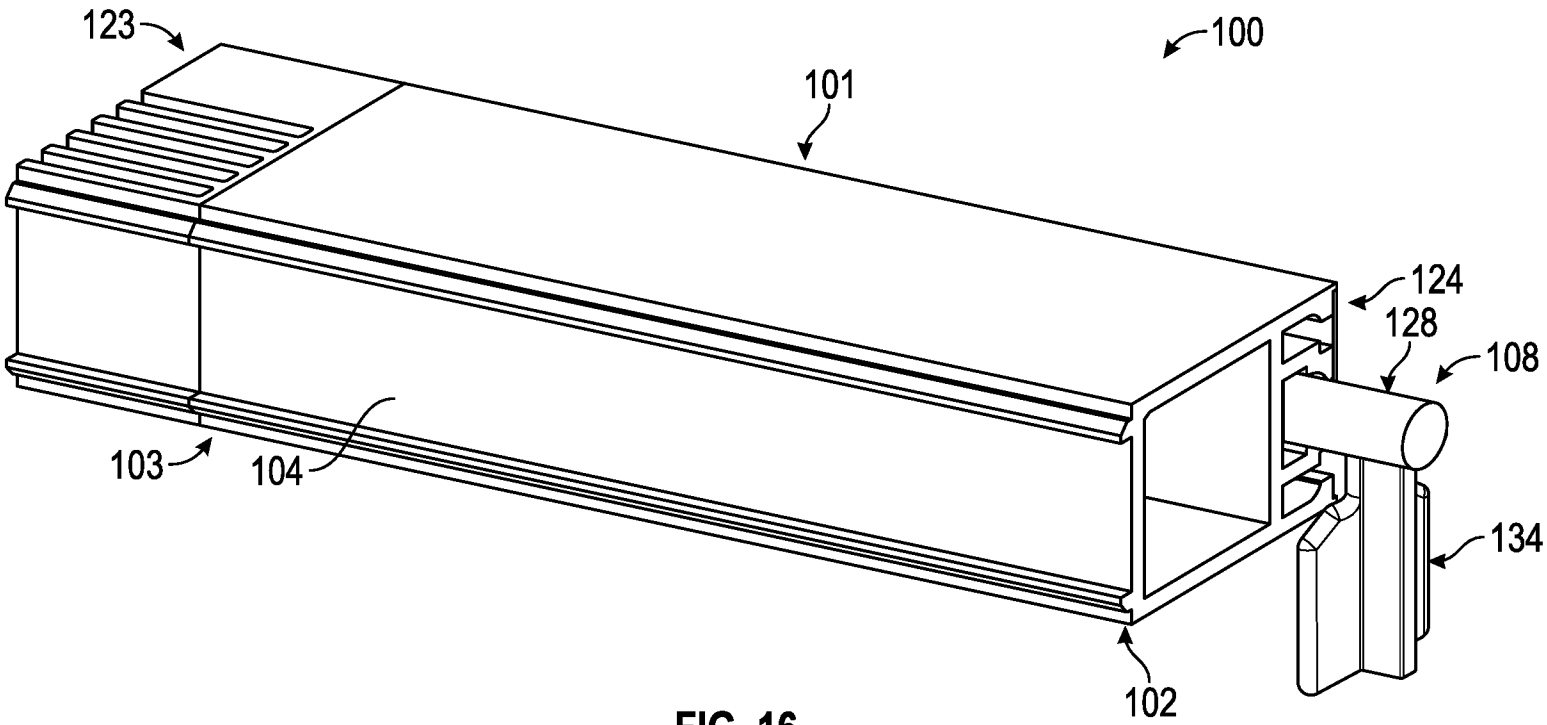
FIG. 16 is a perspective view of the spare staple storage device of FIG. 15.
Figure 19:
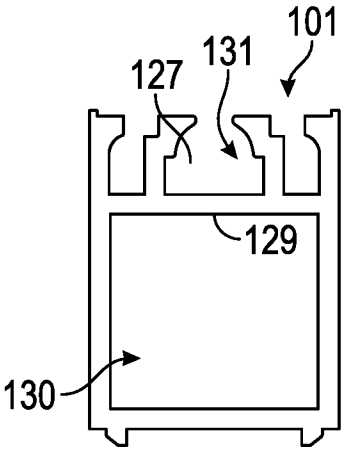
FIG. 19 is a front elevation view of the housing of FIG. 17.
Figure 18:
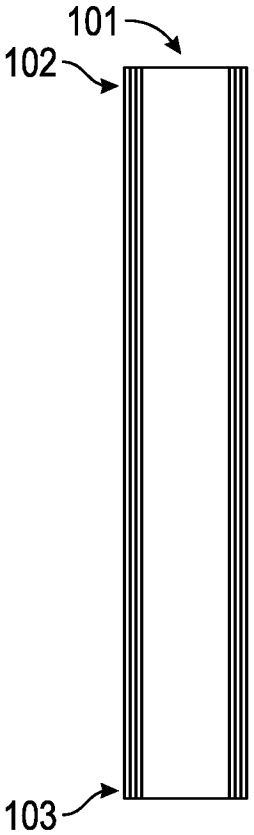
FIG. 18 is a side elevation view of the housing of FIG. 17.
Figure 17:
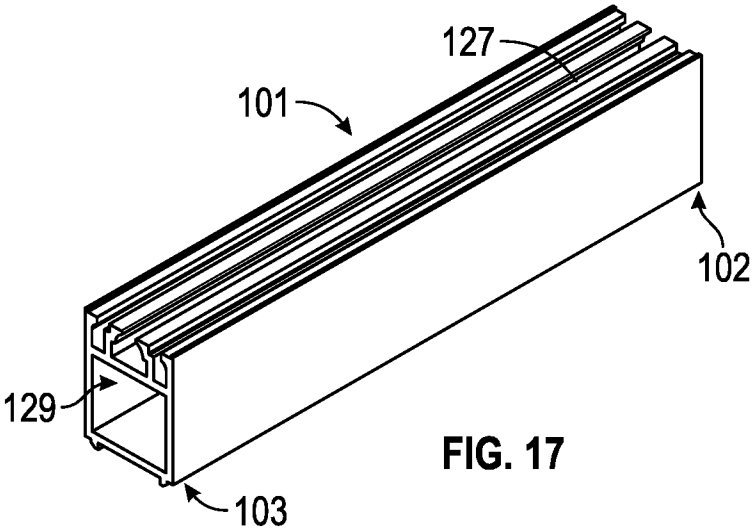
FIG. 17 is a perspective view of the housing of the spare staple storage device of FIG. 15.
Figure 22:
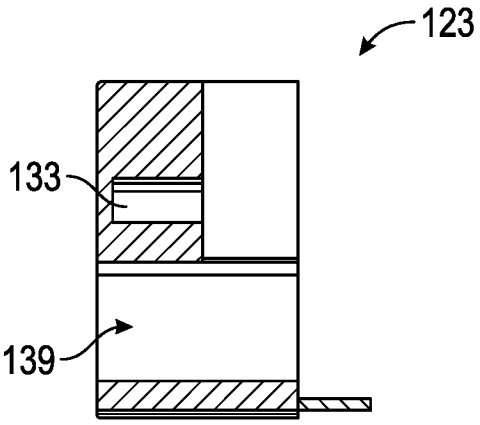
FIG. 22 is a cross-section of the end cap taken through line 22-22 of FIG. 21.
Figure 25:
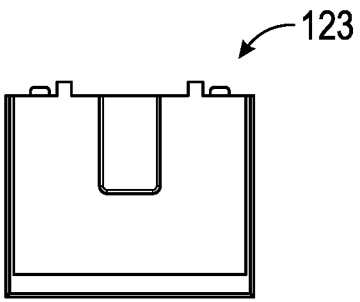
FIG. 25 is a top plan view of the end cap of FIG. 20.
Figure 21:
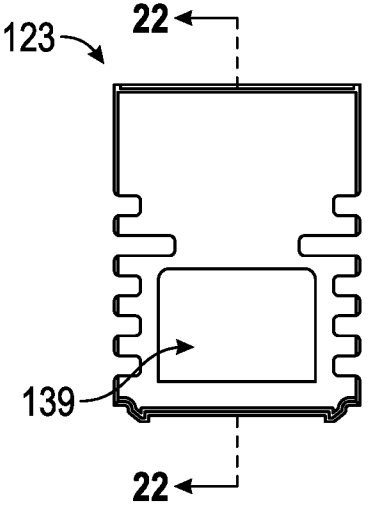
FIG. 21 is a rear elevation view of the end cap of FIG. 20.
Figure 24:
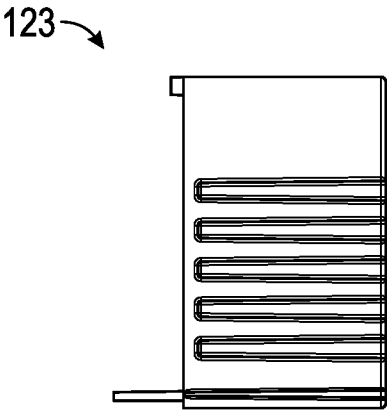
FIG. 24 is a side elevation view of the end cap of FIG. 20.
Figure 20:
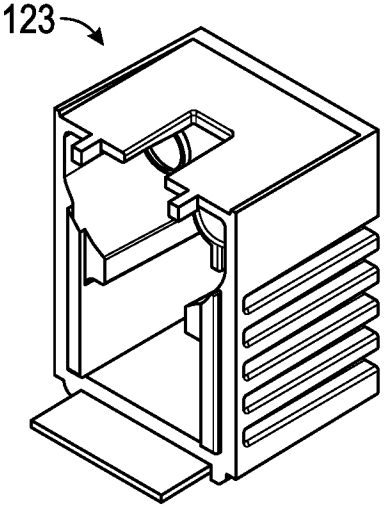
FIG. 20 is a perspective view of an end cap of the spare staple storage device of FIG. 15.
Figure 23:
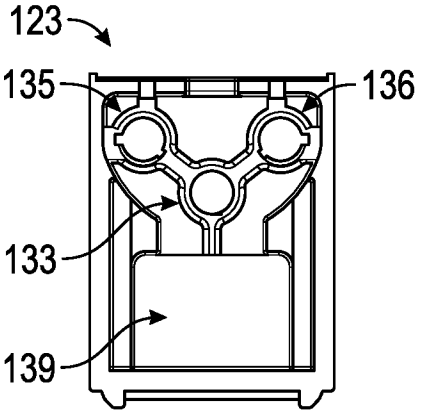
FIG. 23 is a front elevation view of the end cap of FIG. 20.
Figure 26:
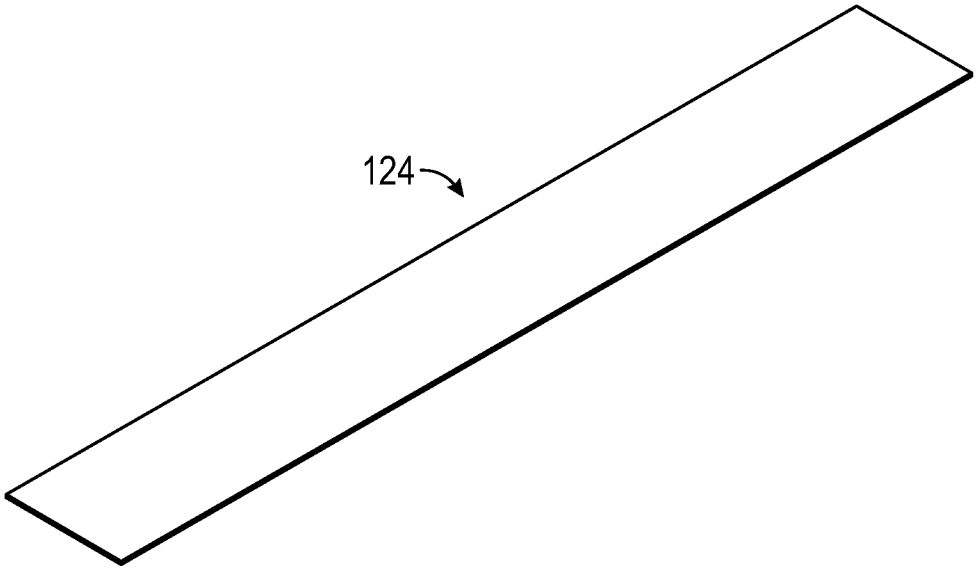
FIG. 26 is a perspective view of a housing cover of the spare staple storage device of FIG. 15.
Figure 27:
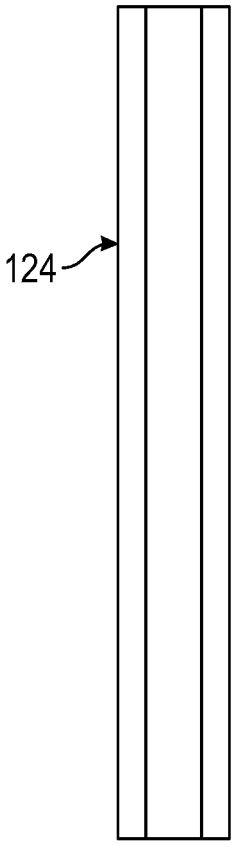
FIG. 27 is a top plan view of the housing cover of FIG. 26.
Figure 28:
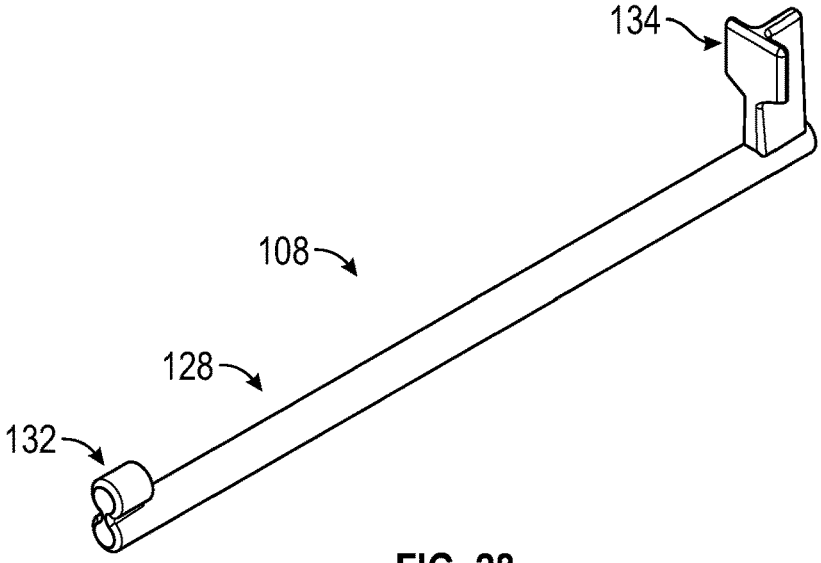
FIG. 28 is a perspective view of the retaining mechanism of the spare staple storage device of FIG. 15.
Figure 29:
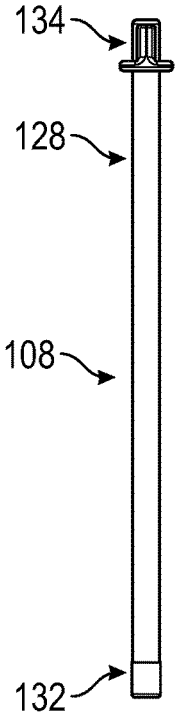
FIG. 29 is a top plan view of the retaining mechanism of FIG. 28.
Figure 30:
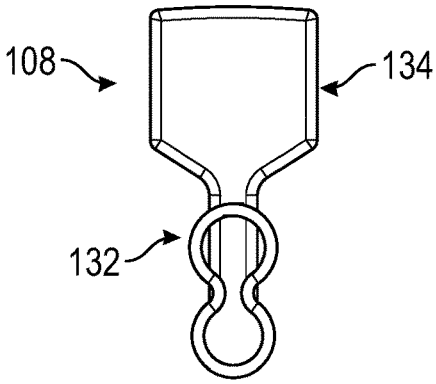
FIG. 30 is a front elevation view of the retaining mechanism of FIG. 28.
Figure 31:
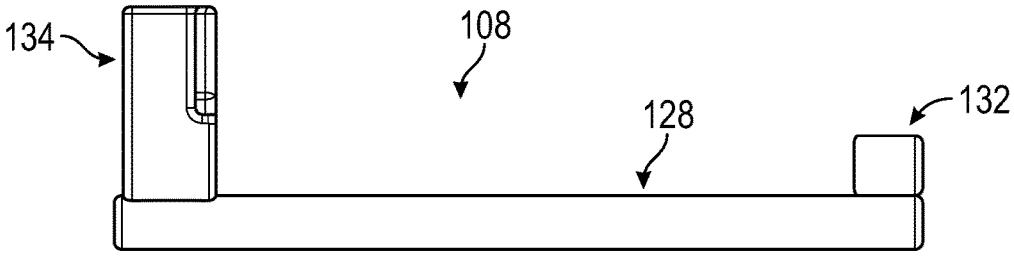
FIG. 31 is a side elevation view of the retaining mechanism of FIG. 28.
Figure 32:
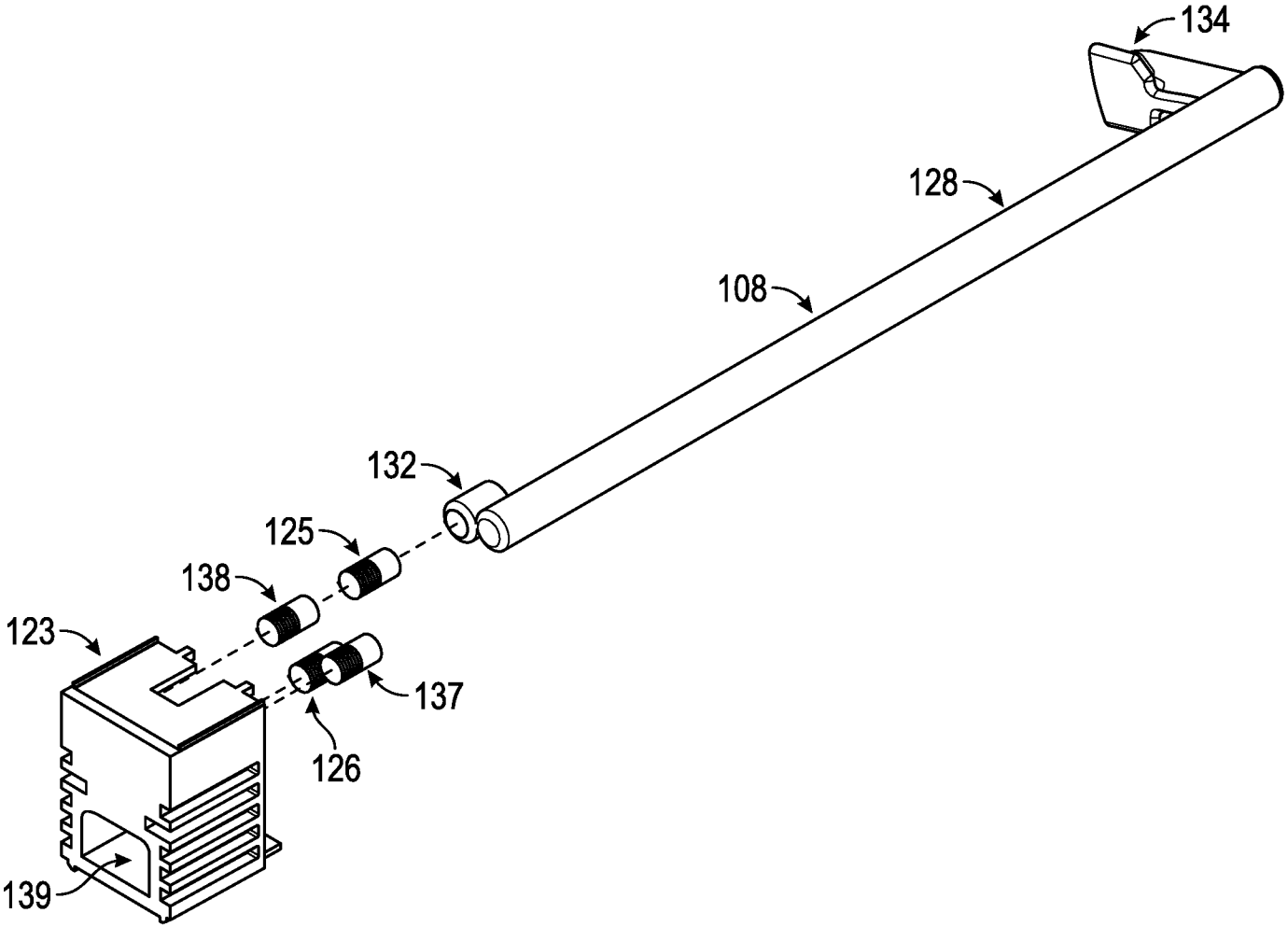
FIG. 32 is a perspective view of a magnet of the spare staple storage device of FIG. 15.

Turning to FIGS. 15-32, a spare staple storage device 100 is disclosed, which may include a housing 101, a retaining mechanism 108, an end cap 123, a first magnet 125, and a second magnet 126.

The housing 101 may have a first end 102 and an opposing second end 103. A flat surface 104 of the housing 101 may secure to a stapler using a piece of double-sided tape or the like. A plurality of staple strips may be stored within the housing 101 and be removed to replenish a staple supply in the stapler chamber.

The housing 101 may have an interior wall 129 dividing an interior volume of the housing 101 into a first chamber 130 and a second chamber 131. The plurality of staple strips may be carried within the first chamber 130. A channel 127 adapted to capture the retaining mechanism 108 may be located within the second chamber 131. The channel 127 may extend along an entirety of the length of the housing 101 and be defined by opposing side walls, which may be mirror images of one another, and a bottom surface, which may be the interior wall 129. The channel 127 may be open along a top side. A housing cover 124 may be positioned along a length of the housing 101 to cover the open side of the channel 127 and the open side of the second chamber 131.

The housing 101 may be formed by extrusion and be uniform along an entirety of its length. The housing 101 may have a first centerline extending vertically from a top surface to a bottom surface of the housing 101, perpendicular to a length of the housing 101. The housing 101 may have a second centerline extending vertically from the top surface to the bottom surface of the housing 101, along the length of the housing 101. The housing 101 may be symmetrical about the first centerline and the second centerline.

The retaining mechanism 108 may be carried by the housing 101 and have an elongate portion 128, a magnet retainer 132, and a protuberance 134. The elongate portion 128 may be an elongate member extending between the magnet retainer 132 and the protuberance 134. The protuberance 134 may be secured to a first end of the elongate member 128 and may extend beyond an outer perimeter of the elongate portion 128, having a longitudinal axis perpendicular to the longitudinal axis of the elongate portion 128. The protuberance 134 may be sized to occlude an opening in the first end 102 of the housing 101. The protuberance 134 may not extend beyond the perimeter of the opening when in the closed configuration.

The magnet retainer 132 of the retaining mechanism 108 may be secured to a second end of the elongate portion 128 and may be secured to the elongate portion 128 below, or offset from, a central axis of the elongate portion 128. In one embodiment, the magnet retainer 132 may be a hollow tube adapted to carry a magnet 125 secured within the tube. Rotation of the retaining mechanism 108 may move the magnet 125 about a central axis of the retaining mechanism 108.

The retaining mechanism 108 may be moved into the channel 127 by positioning the elongate portion 128 along the same longitudinal axis as the length of the channel 127 with the magnet retainer 132 of the retaining mechanism 108 positioned distal the interior wall 129. Once the elongate portion 128 of the retaining mechanism 108 is within the entire length of the channel 127 and the magnet retainer 132 extends beyond the length of the channel 127, the retaining mechanism 108 may be rotated to position the magnet retainer 132 below the top surface of the housing 101. The end cap 123 may be secured to the end of the housing 101 with the magnet retainer 132 secured within the end cap 123 between the second end 103 of the housing 101 and the magnet retainer 133 of the end cap. After the end cap 123 is secured to the housing 101, the retaining mechanism 108 is prevented from rotating to position the magnet retainer 133 above the opening in the top of the channel 127, thereby preventing the retaining mechanism 108 from being removed from the housing 101.

The cooperative configurations of the magnet 125 secured to the retaining mechanism 108 and the magnet 126 secured to the end cap 123 position the protuberance 134 of the retaining mechanism 108 across the opening of the first end 102 of the housing 101 to prevent any staple sticks from being removed from within the housing 101. Lateral pressure may be applied to the protuberance 134 to rotate the retaining mechanism 108 and move the magnet 125 of the retaining mechanism 108 away from the magnet 126 of the end cap 123, thereby moving the protuberance 134 away from the opening in the housing 101 and allowing one or more staple sticks to enter or leave the first chamber 130 of the housing 101.

In some embodiments, the end cap 123 may include additional magnet retainers 135, 136, which may carry additional magnets 137, 138. In such an embodiment, there may be one additional magnet 137, 138 and magnet retainer 135, 136 pair or there may be two additional pairs. The one or more magnet retainer 135, 136 and magnet 137, 138 pairs may be configured to position the retaining mechanism in an open configuration, in which the protuberance 134 does not occlude the opening in the housing 101. In embodiments having two magnet retainer 135, 136 and magnet 137, 138 pairs, there may be a first open configuration with the protuberance 134 positioned on a first side of the housing 101 opening and a second open configuration with the protuberance 134 positioned on a second side of the housing 101 opening.

Each magnet retainer 133, 135, 136 of the end cap 123 may be a hollow tube. Each of the hollow tubes may carry a magnet 126, 137, 138 within the circumference of the hollow tube.

The magnet retainers 133, 135, 136 may be positioned with center points along a single arc so that the magnet 125 of the retaining mechanism 108 secures to different magnets 126, 137, 138 as the retaining mechanism 108 is rotated about a central axis. The magnet retainer 133 may have a vertical centerline extending vertically from a top surface of the magnet retainer 133 to a bottom surface of the magnet retainer 133. The magnet retainer 133 may also have a horizontal centerline extending horizontally from a left side surface of the magnet retainer 133 to a right side surface of the magnet retainer 133. The magnet retainer 135 may be located on a first side of the vertical centerline and on a first side of the horizontal centerline. The magnet retainer 136 may be located on a second side of the vertical centerline and on the first side of the horizontal centerline. The magnet retainers 135 and 136 may be equidistant from the magnet retainer 133, vertical centerline, and horizontal centerline.

The end cap 123 may also include an aperture 139, which may create a pathway from the first chamber 130 of the housing 101 to a volume outside of the spare staple storage device 100. Such a configuration may allow debris, which inadvertently enters the first chamber 130, to freely exit the first chamber 130.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced items.

Thus, the scope of the invention should be determined by the appended claims and their legal equivalents, and not by the examples given.

That which is claimed is:

1. A spare staple storage device comprising:

a housing having a first end and an opposing second end and being adapted to secure to a stapler;

a retaining mechanism carrier affixed to the housing;

a retaining mechanism carried by the retaining mechanism carrier and being adapted to selectively occlude a first opening at the first end of the housing; and an elongate occluding member fixedly positioned to occlude a second opening at the second end of the housing.

2. The spare staple storage device of claim 1 wherein the housing comprises a hollow tube.

3. The spare staple storage device of claim 1 wherein the housing comprises a rectangular tube.

4. The spare staple storage device according to claim 1 wherein the retaining mechanism comprises:

an elongate retaining member having a first end and an opposing second end.

5. The spare staple storage device according to claim 4 wherein the retaining mechanism further comprises:

a spring having a first end secured to the second end of the elongate retaining member and a second end secured to the retaining mechanism carrier.

6. The spare staple storage device according to claim 5 further comprising:

an elongate fastening member fixedly positioned within the retaining mechanism carrier and adapted to secure the spring to the retaining mechanism carrier.

7. The spare staple storage device according to claim 5 wherein the elongate retaining member has an aperture in its second end adapted to receive a portion of the spring.

8. The spare staple storage device according to claim 4 wherein the elongate retaining member comprises a threaded rod.

9. The spare staple storage device according to claim 8 wherein the retaining mechanism further comprises:

a threaded nut carried by the threaded rod.

10. The spare staple storage device according to claim 9 further comprising:

at least one staking dimple located on the retaining mechanism carrier between the threaded nut and a first end of the retaining mechanism carrier.

11. The spare staple storage device according to claim 4 wherein the elongate retaining member comprises:

a first elongate portion carried within the retaining mechanism carrier; and a second elongate portion positioned outside of the retaining mechanism carrier and secured to the first elongate portion to form a ninety-degree angle between the first elongate portion and the second elongate portion.

12. The spare staple storage device according to claim 11 wherein the retaining mechanism further comprises a tube carried by the second elongate portion.

13. The spare staple storage device according to claim 1 wherein the first end of the housing has a detent adapted to capture at least a portion of the retaining mechanism.

14. The spare staple storage device according to claim 1 wherein a stapler is affixed to a flat surface of the housing.

15. A spare staple storage device comprising:

a housing comprising:

a first hollow tube having a first end, an opposing second end, and a flat surface adapted to secure to a stapler extending along an entirety of a length of the first hollow tube between the first end and the second end;

a retaining mechanism carrier affixed to the housing and comprising:

a second hollow tube; and a retaining mechanism comprising:

a threaded rod having a first elongate portion carried within the second hollow tube of the retaining mechanism carrier and a second elongate portion positioned outside of the second hollow tube of the retaining mechanism carrier with a ninety-degree angle formed between the first elongate portion and the second elongate portion;

wherein the second elongate portion is adapted to selectively occlude a first opening at the first end of the first hollow tube.

16. The spare staple storage device according to claim 15 wherein the retaining mechanism further comprises:

a spring having a first end secured to a second end of the first elongate portion of the threaded rod and a second end secured to the second hollow tube.

17. The spare staple storage device according to claim 15 wherein the retaining mechanism further comprises a threaded nut carried by the threaded rod; and wherein the spare staple storage device further comprises at least one staking dimple located on the second hollow tube between the threaded nut and a first end of the second hollow tube.

18. A spare staple storage device comprising:

a housing comprising:

a hollow, rectangular tube having a first end, an opposing second end, and a flat surface adapted to secure to a stapler extending along an entirety of a length of the hollow, rectangular tube between the first end and the second end;

a retaining mechanism carrier affixed to the hollow, rectangular tube;

a retaining mechanism comprising:

a threaded elongate retaining member having a first elongate portion carried by the retaining mechanism carrier and a second elongate portion positioned outside of the retaining mechanism carrier and secured to the first elongate portion to form a ninety-degree angle between the first elongate portion and the second elongate portion, an aperture formed in the first elongate portion of the threaded elongate retaining member, a tube carried by the second elongate portion of the threaded elongate retaining member, a spring having a first end captured by the aperture of the first elongate portion of the threaded elongate retaining member, an elongate fastening member fixedly positioned to capture the spring and secure a second end of the spring to the retaining mechanism carrier, a threaded nut carried by the threaded elongate retaining member, and at least one staking dimple located on the retaining mechanism carrier between the threaded nut and a first end of the retaining mechanism carrier, wherein the second elongate portion is adapted to selectively occlude a first opening at the first end of the hollow, rectangular tube; and an elongate occluding member fixedly positioned to occlude a second opening at the second end of the hollow, rectangular tube;

wherein the first end of the hollow, rectangular tube has a detent adapted to capture at least a portion of the retaining mechanism.

* * * * *